US007059087B2

(12) United States Patent
Allen

(10) Patent No.: US 7,059,087 B2
(45) Date of Patent: Jun. 13, 2006

(54) CORNER FLASHING FOR WINDOWS AND THE LIKE

(76) Inventor: L. Ross Allen, 1201 Jericho La., Charlotte, NC (US) 28270

( * ) Notice: Subject to any disclaimer, the term of this patent is extended or adjusted under 35 U.S.C. 154(b) by 0 days.

(21) Appl. No.: 10/753,135

(22) Filed: Jan. 7, 2004

(65) Prior Publication Data

US 2005/0166470 A1 Aug. 4, 2005

(51) Int. Cl.
*E04B 1/70* (2006.01)
*E04F 17/00* (2006.01)

(52) U.S. Cl. ..... 52/58; 52/62; 52/204.1; 52/302.1; 52/302.3; 52/302.6

(58) Field of Classification Search ..... 52/58–62, 52/11, 219, 213, 204.1, 302.1, 302.3, 302.6
See application file for complete search history.

(56) References Cited

U.S. PATENT DOCUMENTS 1,677,130 A * 7/1928 Cherry ..... 52/209
1,935,116 A * 11/1933 Friedberg ..... 52/302.6
1,976,166 A * 10/1934 Fricdberg ..... 52/302.6
2,154,734 A * 4/1939 Doing ..... 52/302.6
2,296,499 A * 9/1942 Buetow ..... 52/302.6
2,648,107 A * 8/1953 Bates, Jr. ..... 52/97
2,697,932 A 12/1954 Goodwin
3,124,427 A * 3/1964 Chomes ..... 428/603
3,239,977 A 3/1966 Shore
4,492,062 A 1/1985 Levenez
4,555,882 A 12/1985 Moffitt et al.
4,594,818 A * 6/1986 Prestidge ..... 52/58
4,745,716 A * 5/1988 Kuypers ..... 52/169.5
4,750,301 A * 6/1988 Croxford ..... 52/58
4,951,431 A * 8/1990 Sweers ..... 52/58
4,966,819 A * 10/1990 Schatz et al. ..... 428/603
5,072,552 A * 12/1991 Sauder ..... 52/58
5,115,603 A * 5/1992 Blair ..... 52/13
5,349,792 A * 9/1994 Bayes ..... 52/62
5,377,464 A 1/1995 Mott et al.
5,414,964 A * 5/1995 Bodycomb ..... 52/58
5,605,019 A * 2/1997 Maziekien et al. ..... 52/58
5,822,934 A * 10/1998 O'Donnell ..... 52/209
5,894,697 A * 4/1999 Hunter ..... 52/58
5,921,038 A * 7/1999 Burroughs et al. ..... 52/209
5,946,870 A * 9/1999 Bifano et al. ..... 52/254
5,956,909 A * 9/1999 Chou ..... 52/209
6,047,502 A * 4/2000 Kimmitt et al. ..... 52/12
6,122,874 A * 9/2000 Smerilli ..... 52/408
6,293,064 B1 * 9/2001 Larson ..... 52/302.1
6,298,621 B1 * 10/2001 Lee ..... 52/302.6

(Continued)

OTHER PUBLICATIONS

Lincoln Wood Products, Inc., *Flanged Window Installation*; instructions; Mar. 2003; two pages.

(Continued)

*Primary Examiner*—Jeanette E. Chapman
(74) *Attorney, Agent, or Firm*—Alston & Bird LLP

(57) ABSTRACT

A flashing and method for installing a window or other portal in a wall opening is provided. The flashing includes a base member with first and second portions that are angled so that an outer surface of the first portion can be disposed against a sill of the opening and an outer surface of the second portion can be disposed against one of the jambs of the opening. A front face plate of the flashing extends perpendicularly from the first and second portions of the base member, and a plurality of channels in the base member are structured to direct water toward and through the front face plate.

5 Claims, 2 Drawing Sheets

U.S. PATENT DOCUMENTS

| | | | | |
|---|---|---|---|---|
| 6,305,130 | B1 | 10/2001 | Ackerman, Jr. | |
| 6,385,925 | B1 * | 5/2002 | Wark | 52/209 |
| 6,401,401 | B1 * | 6/2002 | Williams | 52/58 |
| 6,401,402 | B1 | 6/2002 | Williams | |
| 6,457,279 | B1 * | 10/2002 | Jacobsen et al. | 52/58 |
| 6,526,709 | B1 | 3/2003 | Jacobsen | |
| 6,539,675 | B1 * | 4/2003 | Gile | 52/96 |
| 6,681,530 | B1 * | 1/2004 | Givens | 52/58 |
| 6,715,237 | B1 * | 4/2004 | Batt, Sr. | 52/11 |
| 6,792,725 | B1 * | 9/2004 | Rutherford | 52/209 |
| 2005/0204657 | A1 * | 9/2005 | Ellingson | 52/204.1 |
| 2005/0262782 | A1 * | 12/2005 | Harrison et al. | 52/204.53 |

OTHER PUBLICATIONS

Andersen Corporation; Andersen® Windowalls®; *Perma-Shield®Double-Hung Windows*; PP/Product Presentation; p. 22 and 23.

Search Report, dated Apr. 5, 2005; PCT/US2005/000351, Filing Date Jun. 1, 2005.

* cited by examiner

CORNER FLASHING FOR WINDOWS AND THE LIKE

FIELD OF THE INVENTION

This invention relates to the installation of windows or other building members and, more particularly, relates to a flashing for directing water and preventing leakage of the water at a window or other portal.

BACKGROUND OF THE INVENTION

During a typical installation of a window in a building, a rough opening is first prepared in a wall of the building for receiving the window. The rough opening is defined by two jambs that extend vertically from a head at the top of the rough opening to a sill at the bottom of the opening. A weather resistant barrier material, such as a thin sheet of waterproof paper or plastic can be disposed over the outer surface of the wall, and the barrier material is cut at the rough opening and folded into the opening. The barrier material forms a moisture barrier extending over the outer surface, but due to the cuts in the barrier material does not normally provide a waterproof barrier on the inner surfaces of the rough opening. In particular, the barrier typically defines openings at the intersection of the jambs and the sill. A sill flashing is often installed across the sill. The sill flashing extends outward from the sill onto a portion of the outer surface of the wall and upward from the sill onto a portion of each jamb. Thus, the sill flashing, which is formed of a flexible sheet of material, is cut and bent to correspond to the sill, jambs, and outer wall surface. Typically, two cuts are made in the sill flashing, each cut extending from a respective corner of the sill and the jambs through the portion of the sill flashing that is disposed on the outer surface of the wall. Similarly, flashing can be installed on each of the jambs and the head of the rough opening before the window is secured in the opening.

The window can be structured to prevent rain or other water contacting the outer surface of the window from flowing to the sill of the rough opening. However, in some cases, the window can leak water to the sill. Water flowing to the sill of the rough opening can sometimes penetrate both the barrier material and the flashing, e.g., through the cuts that are made in the barrier material and the flashing during installation. Thus, the water can flow into the wall, i.e., between the inner and outer surfaces of the wall, causing damage to the wall.

Thus, there exists a need for a device and method for use in a window installation for preventing the flow of water to the rough opening in the wall and to the inside of the wall. The device should be compatible with conventional windows and installation methods. Preferably, the device should be relatively easy to install and economical to manufacture.

SUMMARY OF THE INVENTION

The present invention provides a corner flashing and method for use in installing a portal, such as a window, in an opening in a wall. The flashing defines channels for directing water outward of the wall, thereby restricting the passage of water inward through the wall around the portal.

According to one embodiment of the present invention, the wall is defined by a sill and jambs extending therefrom. The flashing includes a base member with first and second portions. The second portion is disposed at an angle relative to the first portion, such as a right angle, so that an outer surface of the first portion can be disposed against the sill of the opening and an outer surface of the second portion can be disposed against one of the jambs of the opening. The flashing also includes a front face plate that extends generally perpendicularly from the first and second portions of the base member. The first and second portions of the base member define the channels for directing water toward and through the front face plate. For example, the channels can be tapered to define an increased depth at the front face plate. Inner surfaces of the first and second portions of the base member can also have ridges between the channels for defining a surface substantially parallel to the outer surfaces and structured to support the window or other portal. The outer surfaces of the portions opposite the channels can be substantially planar. According to one aspect of the invention, the flashing, which can be made of plastic, is a unitary member. Further, the flashing can be a universal device that is structured to be selectively installed in either of two corners of the opening, i.e., with the outer surface of the first portion of the base member disposed toward either the sill or one of the jambs of the opening.

The present invention also provides a window assembly in an opening of a wall. The window assembly includes a wall defining an outer surface and an opening therethrough having a sill and jambs with corners at the intersections of the jambs and the sill. Flashings are disposed at the corners of the wall opening, with the channels of the flashings disposed in the base members of the flashings. A window is disposed in the wall opening with corners of the window being received by the flashings so that the inner surfaces of the first and second portions of the base member of each flashing are disposed toward the window. Thus, the channels of the first portion of each flashing are structured to direct water toward the outer surface of the wall and through the front face plate. The flashings can be substantially similar so that each flashing is configured to be disposed at either of the wall corners.

Additionally, the present invention provides a method of installing a window in a wall opening. The method includes disposing first and second flashings at the corners of the wall opening and disposing a window in the opening. The window has first and second corners that are received by the flashings so that the inner surfaces of the base member of each flashing are disposed toward the window. Channels in the first portion of each flashing are structured to direct water toward the outer surface of the wall and through the front face plate. A laminar moisture barrier sheet can also be disposed against the outer surface of the wall, and each of the flashings can be disposed partially between the sheet and the wall and partially opposite the sheet from the wall.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate preferred and exemplary embodiments, but which are not necessarily drawn to scale, wherein.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
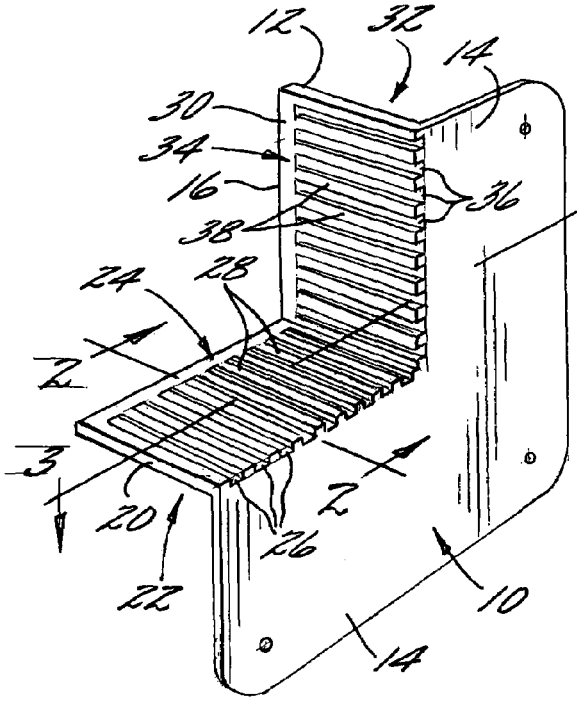
FIG. 1 is a perspective view illustrating a corner flashing according to one embodiment of the present invention.

Referring to the drawings and, in particular, to FIG. 1, there is shown a corner flashing 10 according to one embodiment of the present invention. The corner flashing 10 is structured to be installed in a wall opening 50 in connection with the installation of a window 60 (FIG. 5) or other portal in the opening 50 so that the flashing 10 directs water out of the opening 50, e.g., to the outside of a building. Accordingly, the flashing 10 is preferably formed of a waterproof material. For example, the flashing 10 can be formed of a variety of materials including polymers, metals, and the like. In one advantageous embodiment of the invention, the flashing 10 is formed as a unitary member of plastic, such as polypropylene, polyethylene, or polyvinyl chloride (PVC). For example, the flashing 10 can be formed by a conventional injection molding operation using one or more dies that cooperably define a die cavity corresponding to the configuration of the flashing 10 so as to form the flashing as a unitary, relatively rigid, molded plastic member.

Figure 6:
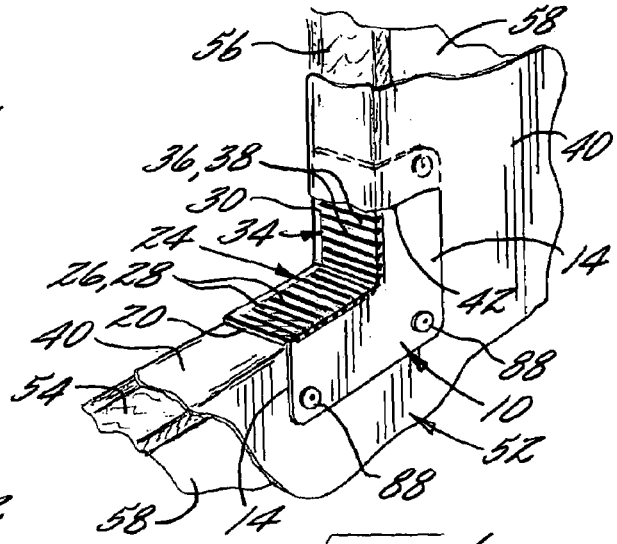
FIG. 6 is a partial view of FIG. 5 illustrating one of the installed flashings.

As shown in FIG. 1, the flashing 10 includes an L-shaped base member 12 and a front face plate 14. The base member 12 has substantially perpendicular first and second portions 20, 30, and the front face plate 14 extends in a plane that is generally perpendicular to both of the portions 20, 30 of the base member 12. Thus, as shown in FIG. 6, the flashing 10 can be installed in the opening 50 of a wall 52 so that the base member 12 is disposed against a sill 54 and jamb 56 of the wall 52 and the front face plate 14 is disposed against an outer surface 58 of the wall 52. In particular, outer surfaces 22, 32 of the first and second portions 20, 30 can be disposed against the sill 54 and jamb 56 of the wall 52 so that opposite inner surfaces 24, 34 of the base member portions 20, 30 are configured to receive corners 62 of the window 60.

Figure 2:
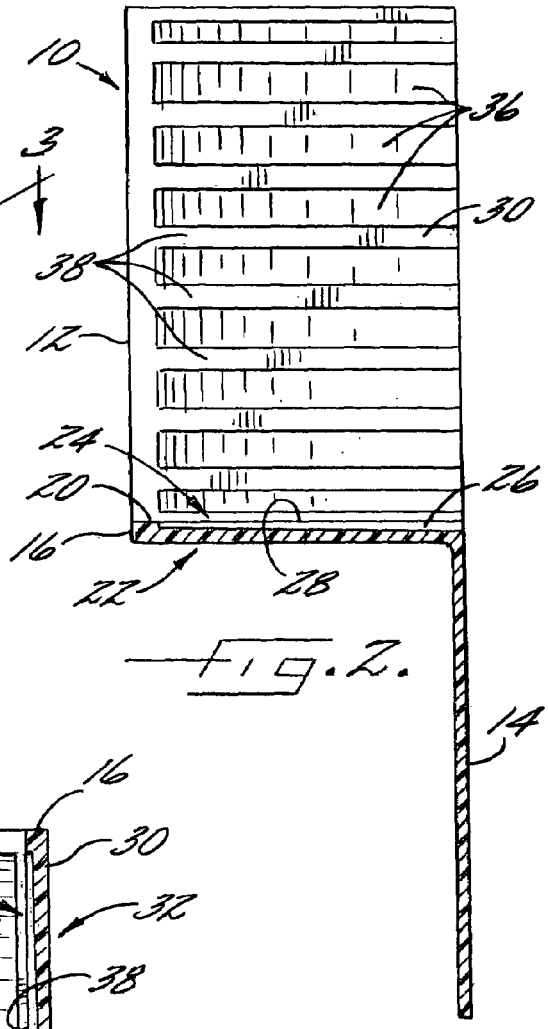
FIG. 2 is a section view illustrating the flashing of FIG. 1, as seen along line 2—2 of FIG. 1.
Figure 3:
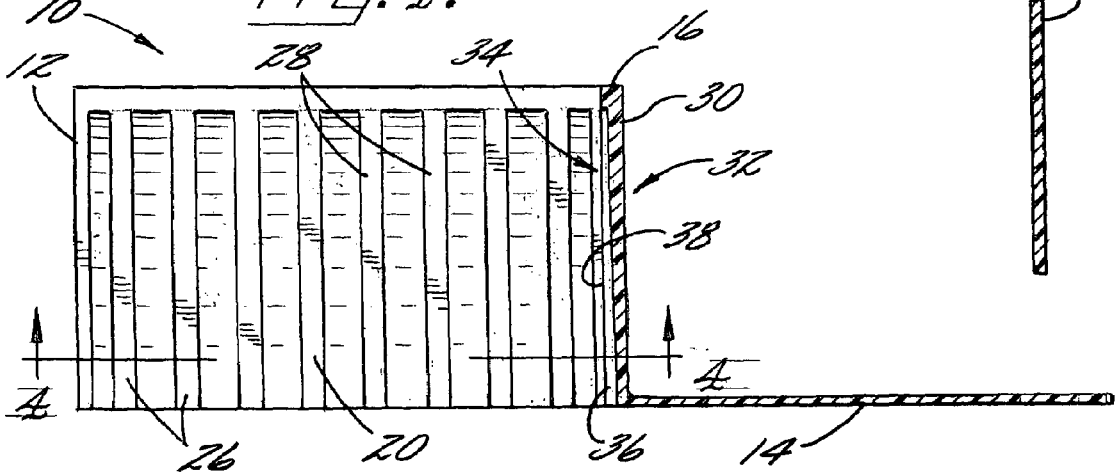
FIG. 3 is a section view illustrating the flashing of FIG. 1, as seen along line 3—3 of FIG. 1.
Figure 4:
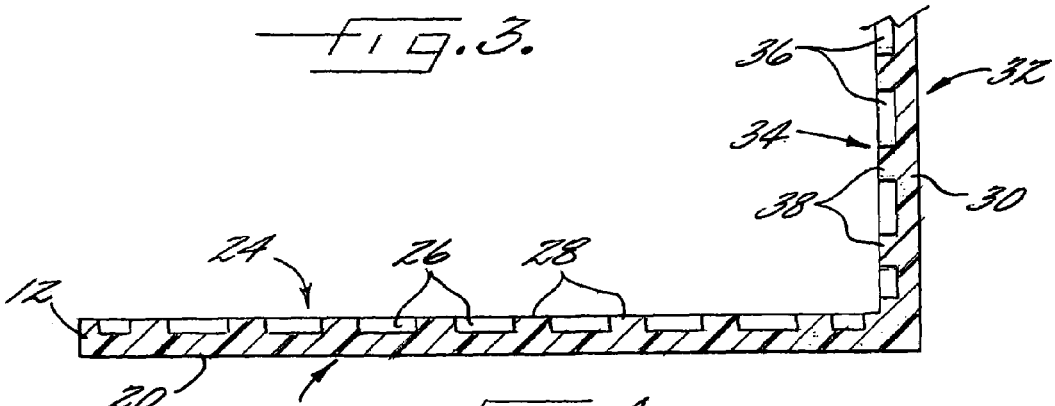
FIG. 4 is a section view illustrating the flashing of FIG. 1, as seen along line 4—4 of FIG. 3.

The inner surfaces 24, 34 of the base member 12 define channels 26, 36 that extend to the front face plate 14 so that water received on the inner surfaces 24, 34 is directed by the channels 26, 36 through the front face plate 14. As shown in FIGS. 1 and 3, the channels 26, 36 are substantially parallel to each other and perpendicular to the front face plate 14, but in other embodiments of the invention, the channels 26, 36 can be angled relative to the front face plate 14. In either case, the channels 26, 36 preferably do not extend through the end edge 16 of the base member 12 opposite the front face plate 14. Further, as shown in FIG. 2, the channels 26, 36 are tapered in a direction away from the front face plate 14, i.e., each channel 26, 36 defines an increased depth at the front face plate 14. Thus, water in the channels 26, 36 generally flows toward the front face plate 14 and exits the channels 26, 36 through the front face plate 14.

The channels 26, 36 are separated by ridges 28, 38 therebetween. The ridges 28, 38 of each portion 20, 30 of the base member 12 define a support surface, which can be substantially parallel to the outer surface 22, 32 of the respective portion of the base member 12. That is, the support surface formed by the ridges 28 of the first portion 20 can be substantially parallel to the outer surface 22 of the first portion 20, and the support surface formed by the ridges 38 of the second portion 30 can be substantially parallel to the outer surface 32 of the second portion 30. Thus, when the outer surfaces 22, 32 of the portions 20, 30 are disposed against the sill 54 and jamb 56 of the wall opening 50, the ridges 28, 38 define support surfaces that are parallel to the sill and jamb 54, 56, respectively.

Figure 5:
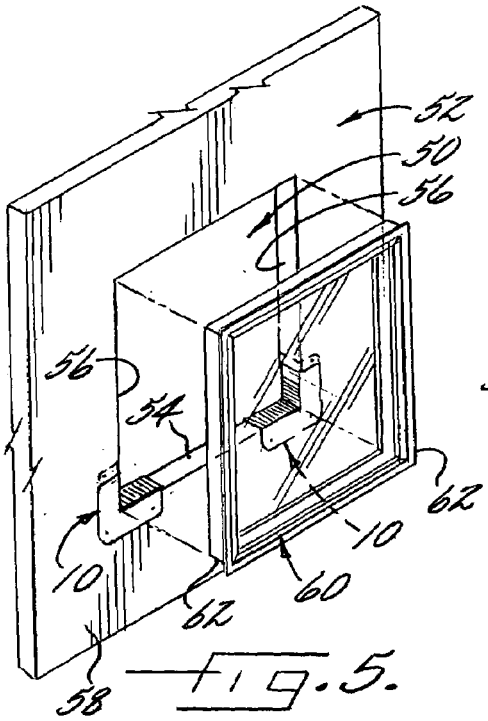
FIG. 5 is a perspective view illustrating two of the flashings of FIG. 1 installed in a wall opening during construction of a wall assembly according to one embodiment of the present invention.

As shown in FIG. 5, the flashings 10 can be installed in each of the lower corners of the opening 50 in the wall 52. When used in connection with the installation of a typical rectangular window 60 in an upright configuration, the first portion 20 of each base member 12 is disposed horizontally against the sill 54 of the wall 52 and the second portion 30 is disposed vertically against one of the jambs 56 of the wall 52. The inner surfaces 24 of the first portions 20 of the base members 12 thereby define a horizontal support surface for receiving and supporting the bottom of the window 60, and the inner surfaces 34 of the second portions 30 define vertical support surfaces for the sides of the window 60.

As is known in the art, the outer surface 58 of the wall 52 can be covered by a laminar sheet 40 of a moisture barrier material, and the sheet 40 can be folded into the opening 50 before the window 60 is installed. According to the present invention, the sheet 40 can be cut as indicated by reference numeral 42 in FIG. 6, so that part of the upright second portion 30 of the base member 12 and the front face plate 14 are inserted between the sheet 40 and the wall 52, while the rest of the flashing 10 is disposed opposite the sheet 40 from the wall 52. Thus, water flowing downward along the sheet 40 tends to flow onto the front face plate 14 or onto the inner surfaces 24, 34 of the base member 12 so that the channels 26, 36 thereby direct the water through the front face plate 14. The lower portion of the flashing 10 is disposed outside the sheet 40 of barrier material, i.e., with the sheet between the flashing 10 and the wall 52, so that water flowing downward from the flashing 10 is directed outside the sheet 40. Advantageously, the flashing 10 can cover any cuts or holes in the sheet 40 at the corner of the opening 50, e.g., cuts made to facilitate the folding of the sheet 40 into the opening 50 or cuts or holes resulting from wear.

Figure 7:
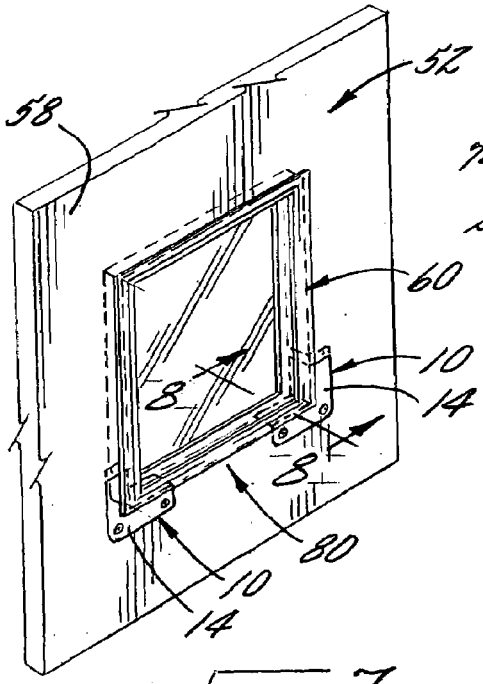
FIG. 7 is a perspective view of a window assembly according to one embodiment of the present invention.
Figure 8:
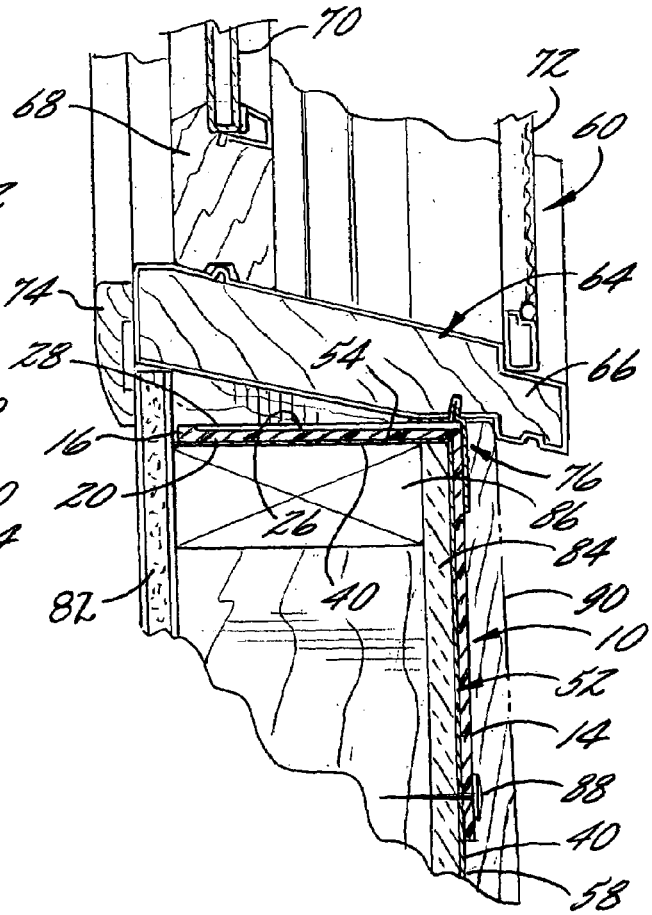
FIG. 8 is a partial section view of the window assembly of FIG. 7, as seen along line 8—8 of FIG. 7.

FIGS. 7 and 8 illustrate a window assembly 80 in which the flashings 10 and window 60 are installed in the opening 50 of the wall 52. The wall 52 typically includes inner and outer wall members 82, 84 supported by framing members 86. For example, the inner wall member 82 can be formed of sheets of plasterboard and the outer wall member 84 can be formed of sheets of plywood, both of which are nailed to and supported by an internal structure of the framing members 86 such as wooden beams. The laminar sheet of barrier material 40 can be provided on the outer surface 58 of the wall 52 and the sill 54. The flashings 10 are installed at each of the two lower corners of the wall opening 50 with the base member 12 of each flashing 10 adjacent to the corner so that the first portion 20 at least partially covers the sill 54 and the second portion 30 of the base member 12 at least partially covers the jamb 56. The front face plate 14 of each flashing 10 is disposed adjacent to the outer surface 58 of the wall 52, and nails 88 or other fasteners can be used to connect the flashings 10 to the wall 52. Siding 90 or other materials can then be disposed on the outer surface 58 of the wall 52, e.g., opposite the sheet 40 from the wall 52, so that the siding 90 covers the front face plate 14 and the wall 52 around the opening 50. For example, the siding 90 can be vinyl or aluminum siding strips, wood shingles, stucco, bricks, and the like.

Windows 60 having any of various configurations can be installed in the wall opening 50 according to the present invention. For example, as shown in FIG. 8, the window 60 includes a frame 64 having a bottom frame member, or sill member 66, that supports a sash 68. One or more glass panes 70 of the window 60 are supported by the sash 68, which fits within the frame 64 of the window. The frame 64 also can support a screen 72 and/or additional glass panes. An inner frame 74 can be provided on the inner wall member 82 to cover an interface between the inner wall member 82 and the window 60, thereby restricting air from passing between the two members 82, 60 and improving the aesthetic appeal of the window assembly 80. A windbreak 76 can also be disposed between the wall 52 and the window frame 64, e.g., proximate to the outer wall member 84, to restrict the passage of air between the wall opening 50 and the window frame 64.

The frame 64, which can be formed of wood, wood composites, polymer coated wood, and the like, can be at least partially supported by the base members 12 of the flashings 10. For example, the sill member 66 of the frame 64 can be supported by the ridges 28 of the first portions 20 of the base members 12. The sill member 66 can also be disposed at an angle relative to the support surface defined by the ridges 28 so that water on the sill member 66 tends to drain outward toward the outer surface 58 of the wall 52. In any case, the channels 26 preferably are directed toward the outer surface 58 of the wall 52 and are not obstructed by the window 60 supported by the ridges 28 so that water received on the first portion 20 of the base member 12 of each flashing 10 is directed toward the outer surface 58 of the wall 52 by the channels 26. Thus, water is prevented from flowing onto the inner wall member 82, the framing members 86, or the outer wall member 84, e.g., through cuts in the barrier material sheet 40 at the corners of the wall opening 50.

Each flashing 10 can be formed with the channels 26 defined by only the first portion 20 of the base member 12, the second portion 30 of the base member 12 being devoid of the channels 36, i.e., so that the channels 26 are disposed under the window 60 when installed but not between the window 60 and the jambs 56 of the opening 50. Preferably, however, the channels 26, 36 are defined by both the first and second portions 20, 30 of the base member 12 of the flashing 10. Further, each flashing 10 is preferably formed as a universal device that can be disposed in either corner of the wall opening 50, i.e., with the first portion 20 of the base member 12 disposed adjacent the sill 54 of the wall opening 50 and the second portion 30 adjacent the jamb 56 of the opening 50, or with the first portion 20 adjacent the jamb 56 of the opening 50 and the second portion 30 adjacent the sill 54. Thus, the flashing 10 can be structured with a single configuration that can be used in either of the corners of the window assembly 80.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A flashing for use in a portal installation in an opening defined by a sill and jambs extending therefrom, the flashing comprising:

a base member having first and second generally flat portions which are joined to each other to define a right angle corner therebetween, said first and second portions defining respective inner surfaces which are disposed on the inside of the right angled corner and outer surfaces which are disposed on the outside of the right angled corner and so that the outer surfaces are parallel to and face oppositely from respective ones of the inner surfaces, with the first and second portions each having parallel opposite end edges, and with the end edges of the first portion lying in respective common planes with the end edges of the second portion, a front face plate extending from end edges of the first and second portions which lie in a common plane, with the front face plate lying in said common plane, and a plurality of channels disposed in the inner surface of each of the first and second portions for directing water toward and through the front face plate, with the outer surfaces of the first and second portions each being substantially planar and free of said channels.

2. The flashing according to claim 1 wherein ridges are defined between the adjacent channels, with the ridges defining a support surface which lies in a plane which is parallel to the plane of the associated outer surface.

3. The flashing according to claim 2 wherein the channels do not extend through the end edges of the first and second portions which are opposite the end edges from which the front face plate extends.

4. The flashing according to claim 2 wherein the channels are tapered so as to define an increased depth at the front face plate.

5. The flashing according to claim 1 wherein the channels do not extend through the end edges of the first and second portions which are opposite the end edges from which the front face plate extends, and wherein the channels are tapered so as to define an increased depth at the front face plate.

* * * * *